US006831023B1

(12) United States Patent
Szerreiks et al.

(10) Patent No.: US 6,831,023 B1
(45) Date of Patent: Dec. 14, 2004

(54) LINOLEUM FLOOR COVERING

(75) Inventors: Uta Szerreiks, Freiberg (DE); Markus Baum, Ludwigsburg (DE)

(73) Assignee: DLW Aktiengesellschaft, Bietigheim-Bissingen (DE)

( * ) Notice: Subject to any disclaimer, the term of this patent is extended or adjusted under 35 U.S.C. 154(b) by 29 days.

(21) Appl. No.: 10/088,983

(22) PCT Filed: Oct. 6, 2000

(86) PCT No.: PCT/EP00/09830

§ 371 (c)(1),
(2), (4) Date: Jun. 4, 2002

(87) PCT Pub. No.: WO01/25528

PCT Pub. Date: Apr. 12, 2001

(30) Foreign Application Priority Data

Oct. 6, 1999 (DE) ..... 199 48 406

(51) Int. Cl.[7] ..... B32B 5/02

(52) U.S. Cl. ..... 442/110; 442/111; 442/417; 442/394; 427/209; 427/58

(58) Field of Search ..... 442/417, 394, 442/110, 111; 427/58, 209

(56) References Cited

U.S. PATENT DOCUMENTS

| | | | | | |
|---|---|---|---|---|---|
| 3,040,210 | A | * | 6/1962 | Charlton et al. | 361/212 |
| 4,301,040 | A | * | 11/1981 | Berbeco | 252/511 |
| 4,770,916 | A | | 9/1999 | Leukel et al. | 428/95 |

FOREIGN PATENT DOCUMENTS

| | | | | | |
|---|---|---|---|---|---|
| DE | 19737397 | C1 | | 8/1997 | D06N/1/00 |
| WO | WO 9910592 | A1 | * | 3/1999 | D06N/1/00 |
| WO | WO 00/53841 | | | 9/2000 | D06N/1/00 |

* cited by examiner

*Primary Examiner*—Elizabeth M. Cole
(74) *Attorney, Agent, or Firm*—Womble Carlyle Sandridge & Rice, PLLC

(57) ABSTRACT

The invention relates to an electrically conductive floor covering based on linoleum, comprising a wear layer and a sub-layer, whereby the floor covering has an electrical volume resistivity $R_1$ according to EN 1081, of a maximum $10^7$ Ω. The invention also relates to a method for producing said floor covering.

10 Claims, 1 Drawing Sheet

LINOLEUM FLOOR COVERING

Figure 1:
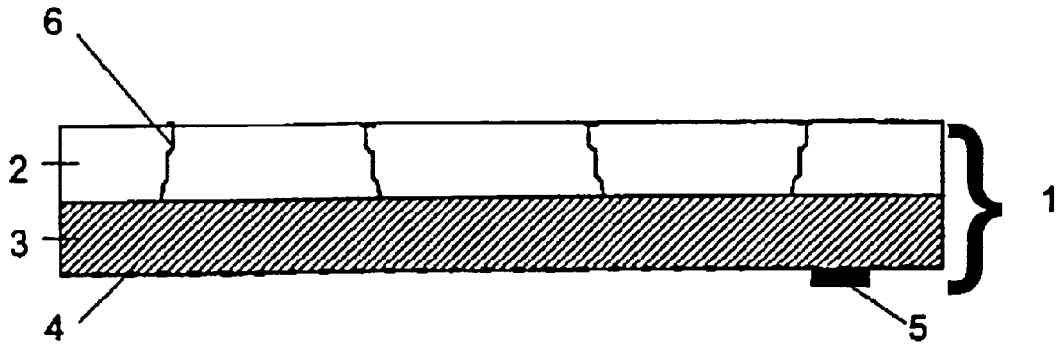

This application claims priority under 35 U.S.C. §119(b) to German Application Ser. No. 19948406.6, filed on Oct. 6, 1999 and PCT application Ser. No. PCT/EP00/09830, filed on Oct. 6, 2000 under 35 U.S.C. §363.

This invention concerns an electrically conductive floor covering based on linoleum which comprises a wear layer and an under layer, with the floor covering having an electrical contact resistance $R_1$ in accordance with EN 1081 of a maximum of $10^7$ Ω, and a method for producing the floor covering.

The market increasingly is demanding PVC-free, light-colored floor coverings with a low electrical resistance, in particular with a contact resistance $R_1$ of a maximum of $10^7$ Ω (contact resistance per EN 1081 or electrical leakage resistance $R_A$ per DIN 51 953). Currently this demand is met only by electrically conductive rubber floor coverings. Such PVC-free, electrically conductive floor coverings based on rubber are described, for example, in DE 34 40 572 A1, DE 196 49 708 A1, and DE 35 45 760 A1.

Recently, however, there has been a heightened demand for floor coverings based on renewable raw materials, the classic example of which is linoleum floor coverings. A conventional linoleum floor covering has a relatively high electrical resistance of around $>10^{10}$ Ω. Therefore such a linoleum floor covering cannot be used in rooms, the floor covering of which must have a certain electrical leakage resistance, such as, for example, in operating rooms of hospitals, laboratories, and computer rooms. Known for such applications is the reducing of contact resistance of the linoleum floor covering through the addition of electrically conductive fillers such as special carbon blacks. The addition of special carbon black, however, has the drawback that the use properties of the linoleum floor covering is deteriorated as a result of the relatively large quantity of carbon black required to achieve adequate electrical conductivity. Second, with the addition of carbon black to the linoleum mixture, possibilities for coloring are practically not present. Also in the use of metal powders for improving the electrical conductivity, the coloring possibilities are significantly restricted and in addition there are altered properties in the mechanical behavior as well as an increase in the weight and a significantly reduced thermal insulation of the floor covering. Therefore it has not been possible up to the present to achieve a conductive linoleum floor covering with bright color and contact resistance $R_1$ of less than $10^8$ Ω.

DE 3416 573 and WO 99/10592 concern electrically conductive floor coverings based on linoleum which through addition of at least one derivative of imidazol, imidazolin, benzixnidazol, or morpholin or a cation-active compound of the same is made electrically conductive or is antistatically equipped. Floor coverings of this kind, however, always have a contact resistance RI of approx. $<10^8$ Ω, with this value additionally depending on the air humidity. In the case of dry air, even these values cannot be achieved.

WO 99/04085 describes a floor covering based on linoleum that is electrically conductive and on which the linoleum wear layer has an irregular pattern, for example marbling, of variously colored zones. The variously colored zones are delineated from each other with sharp contours and demonstrate varying electrical conductivity. Again the zones of this floor covering that are configured so as to be electrically conductive contain large quantities of a conductive filler material and are therefore very darkly colored. Although according to the document, a relatively large range of variation of color configuration appears to be possible, in accordance with example 4, by way of example, a third of the floor covering has a dark coloration. Furthermore, despite a relatively dark coloration, the contact resistances of the floor covering according to the document (6) are always only $>10^7$ Ω. It thus is also not possible with a method of this kind to produce sufficiently electrically conductive floor coverings that essentially have a light color tone throughout.

One objective of the present invention therefore is to provide a linoleum strip suitable as floor covering which has a low contact resistance $R_1$, in particular a contact resistance $R_1$ of a maximum of $10^7$ Ω which in addition is not as strongly independent [sic] on air humidity, and at the same time has a bright color ton. An additional task of the present invention is to indicate a method with which such a linoleum floor covering can be produced.

These objectives are solved with the objects characterized in the claims.

In particular a floor covering based on linoleum is provided that is electrically conductive and that has a wear layer (2) and an under layer (3), with the floor covering having an electrical contact resistance $R_1$ of a maximum of $10^7$ Ω per EN 1081.

For determining the electrical resistance of floor coverings the following values are defined by EN 1081, which replaced DIN 51 953:

1. The contact resistance $R_1$ per EN 1081, which corresponds to leakage resistance $R_A$ per DIN 51 953, is the electrical resistance of a floor covering measured on a sample between the tripod electrode on the surface of the floor covering and an electrode on the underside directly opposite it.
2. In contrast, according to EN 1081, resistance to ground $R_2$, corresponding to resistance to ground $R_E$ per DIN 51 953, is the electrical resistance of a floor covering measured on an installed floor covering between a tripod electrode pressed onto the upper surface and ground.

Designated in the state of the art as "electrically conductive" floor coverings are floor coverings which have resistance to ground $R_2$ measured according to EN 1081 of $<10^9$ Ω.

According to the invention, the floor covering has a contact resistance $R_1$ of a maximum of $10^7$ Ω measured according to EN 1081. Also the resistance to ground $R_2$ of the floor covering is preferably a maximum of $10^7$ measured according to EN 1081.

Figure 2:
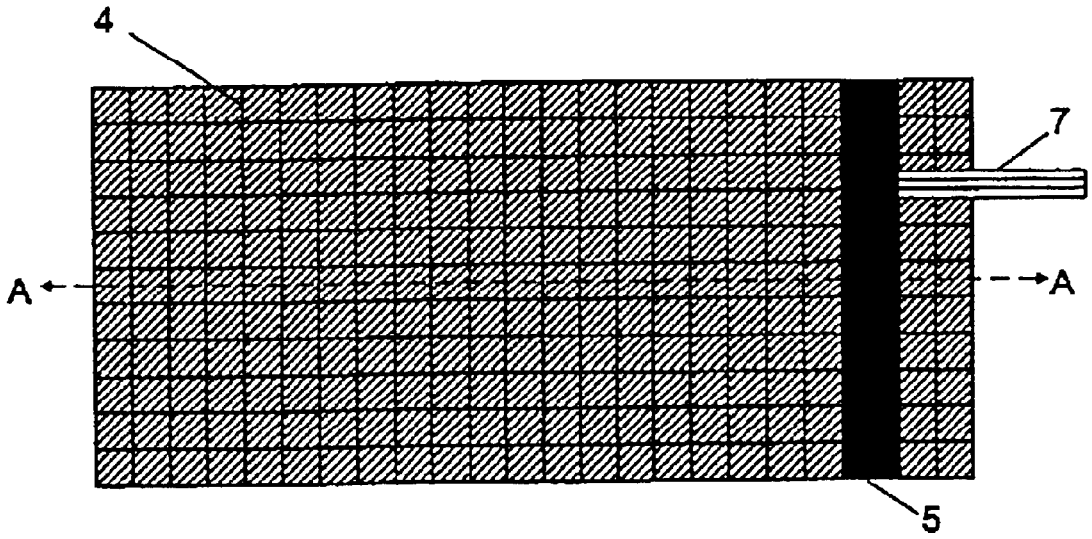

The figures show the following:

FIG. 1 shows a depiction of a schematic cross section through a floor covering (1) according to a preferred embodiment of the present invention along line A—A of FIG. 2. Arranged on a backing (4) are a wear layer (2) and an under layer (3). Particles (6) can be dispersed in the wear layer which comprise a conductive filler material. Arranged on the side of backing (4) facing away from lower layer (3) in this embodiment is a conductivity web (5).

FIG. 2 shows a schematic view of the underside of a floor covering (1) according to an embodiment of the present invention. Arranged on the side of backing (4) facing away from the lower layer is a conductivity web (5). During the installation of the floor covering, this web (5) can, for example, be connected to a copper strip tab (7) by means of which the floor covering is grounded through connecting to ground.

The floor covering according to the invention has a lower layer based on linoleum and a wear layer or top layer based on linoleum. The floor covering preferably has an overall thickness of around 2 mm to around 6 mm, in particular around 2 mm to 4 mm.

According to the invention, the electrical conductivity of the lower layer preferably is achieved through mixing at least one electrically conductive filler material into the linoleum raw mixture. Carbon black and metal powder are preferred as electrically conductive filler materials, with it being possible to use a filler material alone or in combination. In the case of use of carbon black as conductive material, depending on carbon black type, the concentration is preferably about 1% to 20% by weight, more especially preferred about 3% to 15% by weight, in relation to the weight of the conductive mixed mass. By way of example, Ketjenblack® EC-300J (Akzo Nobel), Printex® XE 2 (Degussa AG) or one or several other commercially available carbon blacks can be used as carbon black. In the case of use of metal powder as conductive material, the concentration is about 1.5% to 40% by weight, in relation to the weight of the conductive mixed mass. The quantity used is geared to the density and particle size of the metal powder. By way of example, aluminum, bronze, and VA powder can be used. Any arbitrary mixture of carbon black and one or more metal powders as well as a single metal powder or a mixture of several metal powders can be used. The quantity relationships in mixtures of carbon black and metal powder are to be selected such that contact resistance $R_1$ of the lower layer, which in the floor covering is in contact with the wear layer, is preferably $\leqq 10^7\ \Omega$ (EN 1081), still more preferred $\leqq 10^5\ \Omega$ (EN 1081).

The lower layer can contain other chemical additives which further improve the conductivity of the linoleum. By way of example, chemical additives of this kind as well as examples of use quantities are described below in association with composition and can be used analogously in the lower layer.

In addition to the aforementioned additives, the lower layer has conventional composition. In particular conventional additives such as processing enhancers, antioxidants, UV stabilizers, lubricants, and the like can be contained in the mixed mass which can be selected depending on the binder.

The lower layer preferably has a thickness of 0.6 mm to 1.4 mm.

The wear layer or upper layer of the floor covering according to the invention is the visible surface in the installed floor covering. According to the invention it can have a higher contact resistance $R_1$ than the lower layer and preferably contains only slight quantities of conductive filler material. A degree of conductivity of the wear layer can be achieved through essentially colorless chemical additives in the linoleum base mass for the wear layer. Preferably morpholin and/or at least one derivate of imidazol, imidazolin, or benzimidazol or a mixture thereof are used as chemical additive. Preferably the chemical additive is worked into the linoleum raw mass in a quantity of 0.5% to 15% by weight, more preferably in a quantity of 4% to 10% by weight in relation to the total weight of the linoleum mass of the wear layer. In the case of the use of chemical additives of this kind, in a preferred embodiment of the invention diatomite, which is also often designated siliceous earth, can be used as a sorbent. Preferably 3% to 5% by weight diatomite in relation to the weight of the linoleum mixed mass is used.

According to the invention, the wear layer can have a bright color and have a plain color or a multicolor pattern. In the wear layer, preferably in place of the decorative color which is provided proportionately in the lowest quantity, an electrically conductive filler such as carbon black and/or metal powder and/or conductive fibers or a mixture thereof are added.

Conductive fibers in the meaning of the invention are in particular graphitized synthetic fibers or synthetic fibers which are jacketed with epoxy-graphitized material. Conductive fibers of this kind can be produced through addition of graphite into the synthetic itself or through sheathing of small synthetic particles with graphite, and in most cases have a gray coloration. As a result of their small dimensions and low additive quantities, however, they appear almost colorless to the human eye.

In the wear layer, there is preferably 0.1% to 5% by weight, especially preferred 0.1% to 2% by weight carbon black and/or 0.1% to 8% by weight, especially 0.1% to 3% by weight metal powder. Through additions of this kind in small quantities, the conductivity of the linoleum wear layer can be improved to below $10^7\ \Omega$. Furthermore, as a result of this small proportion of electrically conductive filler in the wear layer and with the addition of the above mentioned chemical additives, the contact resistance R1 surprisingly is no longer so strongly dependent on the air humidity.

In addition, the upper layer comprises the usual components for linoleum floor coverings such as binding agents (so-called bedford cement or B cement from a partially oxidized linseed oil and at least one resin as tackifier), at least one filler, and if desired at least one colorant. Ordinarily softwood sawdust and/or cork dust (in the case of simultaneous presence of sawdust and cork dust, typically in a weight ratio of 90:10) and/or chalk, kaolin (China clay), and heavy spar are used as filler. The mixed mass ordinarily contains at least one coloring agent such as a pigment (for example titanium dioxide) and/or other conventional coloring agents based on inorganic and organic colorants. As coloring agents, any natural or synthetic colorants as well as inorganic or organic pigments, alone or in any combination may be used. A typical linoleum composition contains, in relation to the weight of the wear layer, approx. 40% by weight binders approx. 40% by weight organic fillers, approx. 15% by weight inorganic (mineral) fillers, and approx. 5% by weight coloring agents. Furthermore the usual additives such as processing enhancers, antioxidants, UV stabilizers, lubricants, and the like may be contained in the mixed mass which can be selected depending on the binder.

The wear layer preferably has a thickness of 1.4 mm to 3.6 mm, especially preferred 1.4mm to 2 mm.

Surprisingly it was determined that the contact resistance of the composite of wear layer and under layer is improved as a result of the conductive under layer compared with the contact resistance of the wear layer. Without wishing to establish a mechanism, it is assumed for this embodiment that the small spreading of a conductive material can serve to a degree as bridges or electrical lines between the surface of the floor covering and the conductive lower layer. As is shown in FIG. 1, according to this embodiment form at least some of the spreading of a conductive material (6) or agglomerates of the same extend through the total thickness of wear layer (2) and establish a connection between the surface of the floor covering and the conductive lower layer (3).

As a further advantage of the present invention, the wear layer containing only very low quantities of electrically conductive filler to an extent can lie "protectively" or "compensatingly" above the lower layer. Since the lower layer can contain relatively large quantities of an electrically conductive filler, its mechanical properties are often deteriorated. These deteriorated properties, however, do not come to play in the total composite of the floor covering according to the invention since the wear layer with good mechanical properties lies above the lower level. By way of example, a somewhat brittle lower level can be protected through an elastic wear layer.

Furthermore the linoleum floor covering according to the invention preferably comprises a backing. As backing material, a material on the basis of natural and/or synthetic woven or knitted fabric as well as textile materials can be used. Examples are jute fabric, mixed fabric of natural fibers such as cotton and viscose staple fiber, fiberglass fabric, fiberglass fabric coated with bonding agent, mixed fabric of synthetic fibers, fabric of core/jacket fibers, for example with a core of polyester and a jacket of polyarnide. A coating of the fiberglass consisting of styrene-butadiene latex can be used as bonding agents for fiberglass fabric.

According to one embodiment of the present invention, a back coating can be applied to the side of the backing away from the lower layer which is electrically conductive and more preferably is not applied in the form of a continuous coating but rather in the form of a web or strip, preferably of a width of 50 mm to 100 mm and a thickness of 50 mm to 200 mm. This preferably web-shaped back coating extends continuously over the entire length of the floor covering strip. It is in electrical contact with the lower layer and during installation of the floor covering can be contacted by way of example with a copper strip tab which is connected to ground potential so that the floor covering can be grounded. While in the state of the art, electrically conductive special adhesives must be used in laying conductive floor coverings in order to establish contact with ground potential, according to this embodiment of the present invention, it is possible to only connect one copper strip tab bonded to the web-like back coating to ground potential and to use an ordinary adhesive for laying the floor covering.

Advantageously a web-like back coating is also applied as the back side of the floor covering is supplied with a stamped imprint through a printing process. For this purpose aqueous carbon black dispersions and polymer dispersions, for example a latex, can be used which contain up to 8% by weight, preferably 4% to 6% by weight of an electrically conductive filler, preferably carbon black. In particular this preferably web-like back coating comprises a polymer material which comprises an electrically conductive filler incorporated therein as described above. An electrically conductive filler incorporated within a polymer material has the advantage that the back coating does not rub off.

The present invention also concerns a method for producing the floor covering based on linoleum according to the invention.

For producing the floor covering according to the invention, the conventional methods for producing multiple layer floor coverings can be used.

As a first step, the method according to the invention comprises the application of the linoleum mass of the lower layer to a backing. For this purpose, all of the components for the linoleum mass as described above are mixed in a suitable mixing apparatus, for example a kneader, roll mill, or extruder, into as homogenous as possible base mass (mixed mass). The mixed mass obtained in this manner is added to a roll mill (for example a calendar) and is pressed under pressure and a temperature of ordinarily 10° to 150° C. (depending on the recipe and process technology) onto a backing material. During the pressing of the mixed mass onto the backing material, the roll mill is adjusted (for example the distance between the cylinders of a calendar) such that the resulting floor covering strip obtains the desired layer thickness. In the linoleum floor coverings according to the invention, the thickness of the lower layer as described above is 0.6 mm to 1.4 mm.

Next, the linoleum sheet for the wear layer is produced which preferably is colored and/or patterned.

In the simplest case, particles of a suitable size of an electrically conductive filler can be spread into a uni-colored or multicolored linoleum mass for the wear layer, if desired together with particles of colored filler and the linoleum mass can be calendared into a linoleum sheet.

According to one embodiment, colored chips of a linoleum mass, which preferably contains electrically conductive filler, can be spread on linoleum sheets produced in this way and pressed into them.

Furthermore, according to one embodiment, a colored and patterned linoleum mass can be produced. For this purpose, mixed masses or base masses of different color are initially produced separately, rolled into sheets, and granulated. Afterwards, different colored granulates are mixed together and then fed to the roll mill (for example a calendar) and formed as a sheet. In special cases, the mixture of different colored granulates prior to application to the backing material is drawn into striped sheets, laid rotated 90° to each other and then calendared with friction, resulting in pattern forms known as such and suggestive of natural marble.

According to a further embodiment, sharp-contoured patterns can be achieved in that different rolled sheets are laid one over the other (doubled) and are brought into close contact and only afterwards are crumbled together. In so doing, particles are created which consist of two different parts which are adhering to each other. One part preferably consists of non-conductive mixed mass and the other part preferably consists of conductive mixed mass. The multiple layer composite of the rolled sheet for example can be granulated, cut, broken, or ground in order to produce the particles. Preferably the composite is processed into granulate. If these particles or the granulate of parts of differing mixed mass are now brought to a roll mill such as a calendar and are applied by rolling onto a backing, an irregular pattern is obtained in which the variously colored zones hanging together and also zones of conductive and non-conductive material are delineated with sharp contours from each other and the colored zones are retained practically pure. These colored zones are bordered by the mixed mass which contain the conductive filler material and therefore is dark to black colored.

In addition to the above methods for producing a patterned linoleum sheet, all other conceivable methods can be used.

A rolled sheet of wear layer of this kind is then pressed with the lower layer into a two-layered linoleum floor covering.

Afterwards the two-layered linoleum floor covering is subjected to the curing treatment usual for linoleum floor coverings.

According to one embodiment of the method according to the invention, at least one, preferably web-like, back strip is applied to the back side of the floor covering. This imprint is preferably applied through a pressing process to the back side of the floor covering.

EXAMPLE

A two-layer floor covering according to the invention was produced in that a lower layer and a wear layer were calendared onto a jute backing and the resulting composite was then cured. The compositions of the lower layer and the wear layer were selected as described in Table 1 below.

Leakage resistance $R_A$ of the lower layer and leakage resistance $R_A$ of the upper layer are also specified in Table 1.

TABLE 1

| Components | Lower Layer Content (% by weight) | Upper Layer Content (% by weight) |
|---|---|---|
| Cement | 38.0 | 34.0 |
| Sawdust | 37.2 | 32.2 |
| Carbon black, conductive | 4.0 | 0.5 |
| Titanium dioxide | — | 7.9 |
| Quatenary ammonium salt | 6.7 | 6.7 |
| Diatomite | 2.4 | 4.0 |
| Aluminum hydroxide | 11.7 | 13.05 |
| Pigments | — | 0.85 |
| Zinc oxide | — | 0.8 |
| Leakage resistance $R_A$ [Ohm]* | $6 \times 10^3$ to $10 \times 10^3$ | $2 \times 10^6$ to $10 \times 10^6$ |

Note: *Leakage resistance $R_A$ was measured based on DIN 51 953, whereby in contrast to DIN 51 953, the upper and lower layers were not conditioned in accordance with the standard.

The composite of lower layer and wear layer had a contact resistance $R_1$ per EN 1081 of $1.9\times10^6$ to $3.8\times10^6$ Ω.

What is claimed is:

1. An electrically conductive floor covering based on linoleum, comprising:

a wear layer wherein the wear layer comprises 0.1% to 5% by weight carbon black or 0.1% to 8% by weight metal powder in relation to the total weight of the wear layer or a combination thereof;

a lower layer, wherein the lower layer contains at least one electrically conductive filler material, wherein the electrically conductive filler material includes 1% to 20% by weight carbon black or 1.5% to 40% metal powder in relation to the conductive mixed mass or a combination thereof;

a backing layer; and a conductive web strip applied to a side of the backing away from the lower layer, wherein the conductive web is in electrical contact with the lower layer, and wherein the floor covering has a contact resistance $R_1$ per EN 1081 (April 1998) of a maximum of $10^7$ Ω.

2. The floor covering according to claim 1, wherein the lower layer has a thickness of 0.6 mm to 1.4 mm.

3. The floor covering according to claim 1, wherein the wear layer comprises a chemical additive for increasing conductivity.

4. The floor covering according to claim 3, wherein the chemical additive is selected from derivatives of imidazol, imidazolin, benzimidazol, morpholin and mixtures thereof.

5. The floor covering according to claim 1, wherein the wear layer has a bright color.

6. The floor covering according to claim 1, wherein the wear layer has a multicolor pattern.

7. The floor covering according to claim 1, wherein the wear layer has a thickness of 1.4 mm to 3.6 mm.

8. The floor covering according to claim 1, wherein the conductive web strip comprises an electrically conductive filler material.

9. A method for producing a floor covering based on linoleum according to claim 1 comprising applying the lower layer onto the backing; and forming the wear layer on the lower layer, further comprising applying a conductive web strip to a side of the backing away from the lower layer, wherein the conductive web is in electrical contact with the lower layer.

10. The method according to claim 9, wherein the back coating is applied through a press process.

* * * * *